US005431246A

United States Patent [19]

Matherly

[11] Patent Number: 5,431,246

[45] Date of Patent: Jul. 11, 1995

[54] DEVICE FOR DISPLACING A GONDOLA

[75] Inventor: John Matherly, Meilen, Switzerland

[73] Assignee: Andrea Matherly, Meilen, Switzerland

[21] Appl. No.: 228,448

[22] Filed: Apr. 15, 1994

[30] Foreign Application Priority Data

Apr. 16, 1993 [DE] Germany ..... 43 12 499.2

[51] Int. Cl.[6] ..... E04G 3/14

[52] U.S. Cl. ..... 182/37; 182/143

[58] Field of Search ..... 182/37, 36, 142, 143, 182/145, 147

[56] References Cited

U.S. PATENT DOCUMENTS 447,898 3/1891 Nygren ..... 182/37 X
2,178,956 11/1939 Dyer .
4,811,819 3/1989 Sugiyama .

FOREIGN PATENT DOCUMENTS 1297234 5/1961 France .
1318229 3/1962 France .
1835998 6/1961 Germany .
2404294 7/1975 Germany .
2251594 7/1992 United Kingdom .
1096358 6/1984 U.S.S.R. ..... 182/143

*Primary Examiner*—Alvin C. Chin-Shue

*Attorney, Agent, or Firm*—Robert W. Becker & Associates

[57] ABSTRACT

A device for displacing a gondola in the vertical and horizontal direction alongside a building has a guide rail with a first and a second end connected to the building. A carriage is slidably connected to the guide rail. A gondola is connected to the carriage so as to be vertically displaceable relative to the carriage and horizontally displaceable parallel with the carriage. A first drive unit is operatively connected to the gondola and has a first pulling member movable so as to be retractable into and releasable from the first drive unit for displacing the gondola. A second drive unit is operatively connected to the gondola and has a second pulling member movable so as to be retractable into and releasable from the second drive unit for displacing the gondola. The first and second drive units cooperate with one another for displacing the gondola in the horizontal and vertical directions and are activatable together in a first operative mode wherein the pulling members are simultaneously retracted, in a second operative mode wherein pulling members are simultaneously released, a third operative mode wherein one of the pulling members is released and the other of the pulling members is retracted, and a fourth operative mode wherein only one pulling member is moved, to displace the gondola in the vertical and horizontal direction, as desired.

5 Claims, 6 Drawing Sheets

DEVICE FOR DISPLACING A GONDOLA

BACKGROUND OF THE INVENTION

The present invention relates to a device for displacing a gondola or a similar receiving or working device that is vertically adjustably suspended with, for example, a carriage supported on a guide rail or a boom.

From German Auslegeschrift 24 04 294 a carriage with a boom that is displaceable along the edge of the roof and has a gondola suspended therefrom is known. In this manner it is possible to laterally displace the gondola by displacing the carriage, and by changing the length of the cables supporting the gondola the gondola is lifted or lowered so that, for example, for cleaning a facade substantially any location on the facade is reachable. However, the supply of energy to the displaceable carriage is often extremely difficult. In most cases it is necessary to entrain a cable and, in order to avoid damage to the cable by the carriage wheels, this cable must be guided in a special manner or it is necessary to install sensitive sliding contacts on the roof of the building. Furthermore, for the known device a relatively large boom is required so that the gondola can be suspended from the edge of the roof. It is furthermore disadvantageous that the carriage which is provided with the boom and at least two drive motors, has a high weight which must be supported by a correspondingly heavily constructed support structure and that the carriage often can only be manuevered with difficulties around roof structures and around corners. Thus, the field of use of such device is relatively limited.

It is therefore an object of the present invention to provide a device for displacing a gondola which can be universally used and also is of a relatively small construction and requires only little expenditure for its design so that it can be manufactured economically. It is especially desirable that for the displacement of the carriage and for the height adjustment of the gondola stationary drive units are to be provided so that the supply of energy to these drive units can be achieved without problems and that entrained cables or sliding contacts are not required, while on the other hand a high operational safety and an easy handling of the device is possible.

BRIEF DESCRIPTION OF THE DRAWINGS

This object, and other objects and advantages of the present invention will appear more clearly from the following specification in conjunction with the accompanying drawings, in which.

Figure 1:
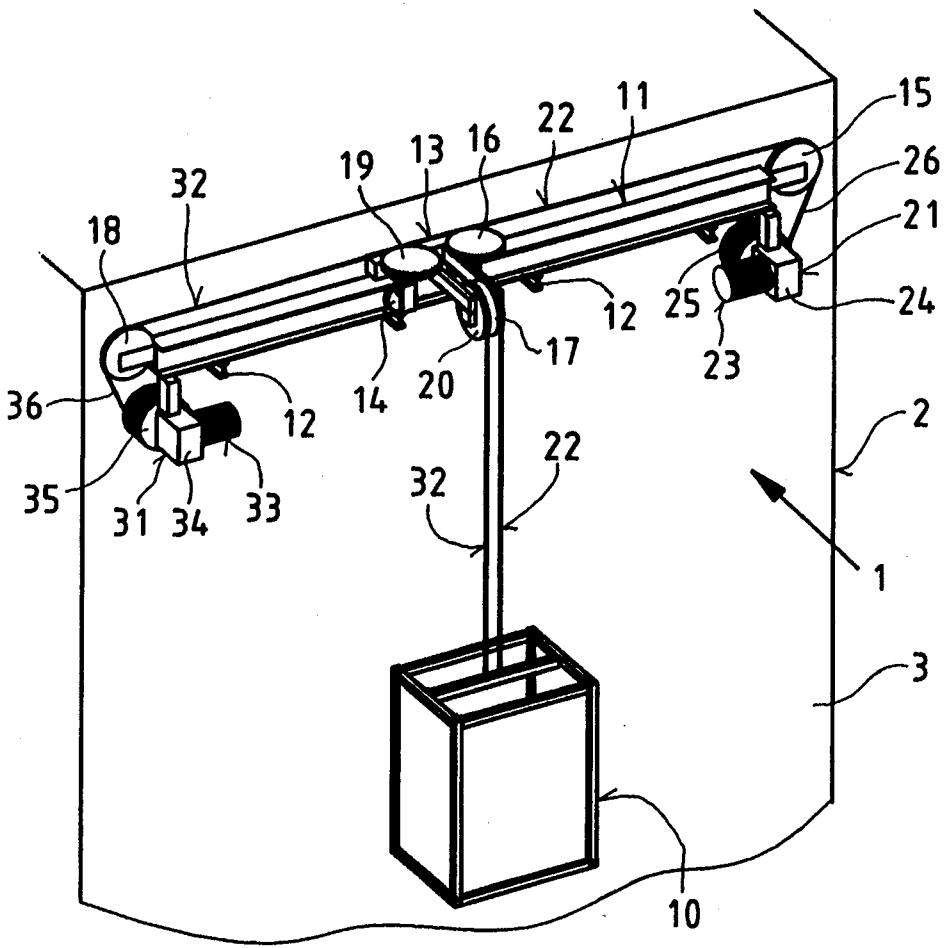
FIG. 1 shows a device for displacing a gondola connected to a building in a perspective view.

The device for displacing a gondola in the vertical and horizontal direction alongside a building wall according to the present invention is primarily characterized by:

A guide rail with a first and a second end connected to a building;

A carriage slidably connected to the guide rail;

A gondola connected to the carriage so as to be vertically displaceable relative to the carriage and horizontally displaceable parallel with the carriage;

A first drive unit operatively connected to the gondola and comprising a first pulling member retractable into and releasable from the first drive unit for displacing the gondola;

A second drive unit operatively connected to the gondola and comprising a second pulling member retractable into and releasable from the second drive unit for displacing the gondola; and Wherein the first and the second drive units cooperate with one another for displacing the gondola in the horizontal and the vertical direction and are activatable together in a first operative mode wherein the first and second pulling members are simultaneously retracted, in a second operative mode wherein the first and second pulling members are simultaneously released, in a third operative mode wherein one of the first and second pulling members is released and the other of the first and second pulling members is retracted, and in a fourth operative mode wherein only one of the first and second pulling members is moved, to thereby displace the gondola in the vertical and the horizontal direction, as desired.

Preferably, the first drive unit is connected to the first end of the guide rail and the first pulling member is connected with a free end thereof to the gondola. In this embodiment, the second drive unit is preferably connected to the second end of the guide rail and the second pulling member is connected with a free end thereof to the gondola.

In another embodiment of the present invention, the first drive unit is connected to the gondola and the first pulling member connected with a free end thereof to the building in the vicinity of the first end of the guide rail. The second drive unit is connected to the gondola and the second pulling member is preferably connected with a free end thereof to the building in the vicinity of the second end of the guide rail.

Alternatively, the first drive unit is connected to the first end of the guide rail and the first pulling member is connected with a free end thereof to the gondola. The second drive unit in this embodiment is connected to the second end of the guide rail and the second pulling member is connected with a free end thereof to the carriage.

In a further embodiment of the present invention, the first drive unit is connected to the first end of the guide rail and the first pulling member is connected with a free end thereof to the gondola. The second drive unit is connected to the carriage and the second pulling member is connected with a free end thereof to the building in the vicinity of the second end of a guide rail.

In yet another embodiment, the first drive unit is connected to the gondola and the first pulling member is connected with a free end thereof to the building in the vicinity of a first and of the guide rail. In this embodiment, the second drive unit is connected to the second end of the guide rail and the second pulling member is connected with a free end thereof to the carriage.

Preferably, the first and the second pulling members are selected from a group consisting of cables and chains, and the carriage comprises at least one pair of guide pulleys for deflecting at least one of the first and second pulling members from the horizontal direction to the vertical direction.

Preferably, the first and second drive units are reversing electric geared motors comprising a reeling drum for receiving the first and second pulling members.

Expediently, the first and the second drive units have a reeling device with a drive motor, the reeling device selected from the group consisting of a driving pulley, a winch, and a capstan.

Preferably, the device further comprises a support structure from which the gondola is suspended by the pulling members.

In a further embodiment of the present invention, the device has a movable support platform and a guide rail connected to the support platform. A carriage is slidably connected to the guide rail and a support structure is connected to the carriage. A gondola is connected to the support structure so as to be vertically displaceable relative to the carriage and horizontally displaceable parallel with the carriage. A first drive unit is connected to a first end of the guide rail and comprises a first pulling member retractable into and releasable from the first drive unit for displacing the gondola. A second drive unit is connected to a second end of the guide rail and comprises a second pulling member retractable into and releasable from the second drive unit for displacing the gondola. The first and the second drive units cooperate with one another for displacing the gondola in the horizontal and the vertical direction and are activatable together in a first operative mood wherein the first and second pulling members are simultaneously retracted, in a second operative mode wherein the first and second pulling members are simultaneously released, in a third operative mode wherein one of the first and second pulling members is retrieved and the other of the first and second pulling members is released, and in a fourth operation mode wherein only one of the first and second pulling members is moved, to thereby displace the gondola in the vertical and the horizontal direction as desired.

According to the present invention the device for displacing a gondola etc. is characterized in that for the vertical and/or horizontal displacement of the gondola two drive units are provided spaced apart from one another which have a flexible pulling member that is preferably reelable onto the drive units wherein the drive units are stationarily connected to the building which supports the carriage, to the gondola, or to the carriage itself, and wherein the pulling members with their free ends are connected to the gondola, the building, or the carriage, and wherein the drive units are individually or together activatable in the same reeling direction or the opposite reeling direction.

It is expedient to provide the pulling members in the form of pulling cables or pulling chains which can be deflected from the horizontal direction into the vertical direction with preferably two guide pulleys per pulling member connected to the carriage at a right angle relative to one another.

The drive units are preferably reversing electric geared motors that are provided with a cable or chain drum for receiving the pulling cable or pulling chains. However, it is also possible to use as the drive units a driving disk, a winch, or a capstan, preferably with coordinated drive motors.

According to a preferred embodiment, the drive units should be positioned on both ends of the guide rail for guiding the carriage, preferably to the building, and the gondola should be suspended from the free ends of the pulling members.

It is also possible that the two drive units are positioned on the gondola and the pulling members with their free ends are connected within the vicinity of the free ends of the guide rail to the building.

According to further embodiments of the invention, one of the drive units may be connected to one of the free ends of the guide rails for the carriage or to the gondola and the other drive unit may be connected to the other free end of the guide rail or to the carriage. The gondola can then be suspended from the free end of the pulling member of one of the drive units or the free end of the pulling member can be connected to the building in the vicinity of the free end of the guide rail, respectively, the other pulling member can be connected with its free end to the carriage or to the building in the vicinity of the free end of the guide rail.

In the alternative, it is also possible to suspend the gondola from a support structure in the form of a boom which is connected directly or with intermediate members to the building. In another embodiment the device may be in the form of a mobile unit having the support structure connected on a displacable carriage on a guide rail movable with the mobile unit.

When a device for displacing a gondola is designed according to the present invention, it is possible to displace via the pulling members and the coordinated drive units the gondola laterally as well as with respect to its height without the need for special safety measures and without a greater expenditure with regard to the manner in which energy is supplied to the device. According to a preferred embodiment, both drive units can be arranged stationarily so that the required energy can be supplied without difficulties and without the need for entrained cables or sliding contacts, whereby it is however still possible with correspondingly controlled drive units to adjust the position of the gondola as desired with respect to a predetermined plane. When using the inventive device as a facade cleaning device any location on the building facade can be reached within a short amount of time.

Since due to the inventive design the carriage can be rather small, the carriage can therefore be directly connected to the edge of the roof and can also be easily manuevered about turns. Since it is only required to displace the carriage and the gondola suspended therefrom, but not the drive units, the required energy is considerably reduced relative to known constructions. With a high operational safety and a simple manipulation the inventive device can be advantageously used for multiple purposes, especially in view of the fact that even inclined lifts (movement at an angle to the horizontal or vertical) are possible.

DESCRIPTION OF PREFERRED EMBODIMENTS

The present invention will now be described in detail with the aid of several specific embodiments utilizing FIGS. 1 through 6.

The device indicated at 1 and represented in FIGS. 1 to 6 is connected to a building 2 and serves for adjusting the position of a gondola 10 in the vertical and horizontal direction in order to, for example, be able to clean in a simple manner the facade 3 of the building 2. The device 1 is comprised substantially of a guide rail 11 that is connected with supports 12 to the building 2. It furthermore comprises a displaceable carriage 13 as well as two drive units 21 and 31 which are in driving connection with the gondola 10 via pulling members 22 and 32.

The carriage 13 is supported with wheels 14 on the guide rail 11 which in cross-section has a T-shape.

The drive units 21 and 31 are in the form of electric motors 23, 33 which are provided with a gear system 24, 34. Cable reeling drums 25, 35 are coupled to the gear systems 24 and 34. The pulling members 26 and 36 preferably in the form of pulling members 22, 32 can be reeled onto the cable reeling drums 25, 35. Via guide pulleys 15, 16 and 17, 18, 19 and 20 the pulling cables 26 and 36 are guided between the reeling drums 25, 35 and the gondola 10 which is thus suspended from the pulling cables 26, 36. The electric motors 23 and 33 are drivable individually or together in the same or in the opposite reeling direction.

In order to adjust the vertical position of the gondola 10 in the embodiment according to FIG. 1, the two electric motors 23 and 33 must be operated in the opposite reeling direction. Depending on the direction of rotation of the cable reeling drums 25 and 35 the pulling cables 26 and 36 are thus retracted or released so that the gondola 10 can be lifted or lowered. When however the electric motors 23 and 33 are operated in the same reeling direction, and the cable drums 25 and 35 are rotated at the same angular velocity, the carriage 13 is displaced to the right or to the left on the guide rail 11 depending on the reeling direction. Of course, it is also possible to operate the cable drums 25 and 35 with the same rotational direction but with different angular velocities so that in this case the gondola is laterally displaced and at the same time lifted or lowered (inclined lifting or lowering).

Figure 2:
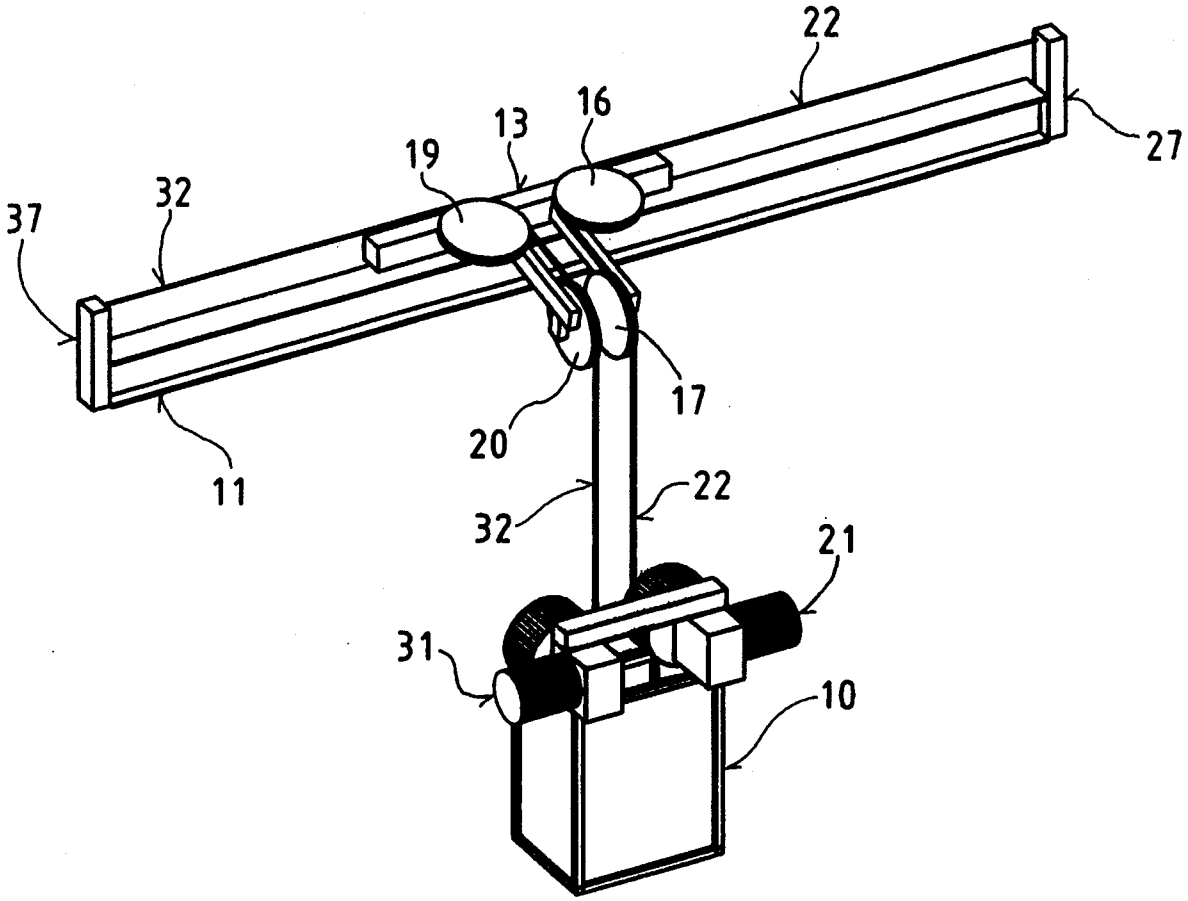
FIGS. 2–5 show different arrangement of the drive units for a device according to FIG. 1 in schematic representation.

In the embodiment according to FIG. 2 the two drive units 21 and 31 are connected to the gondola 10 and the free ends of the pulling members 22 and 32 are connected with fasteners 27 and 37 to the building 2. When driving the drive units 21 and 31 in a controlled manner, the carriage 13 can be displaced on the guide rail 11 and/or the vertical position of the gondola 10 can be adjusted in the same manner as described in connection with FIG. 1.

Figure 3:
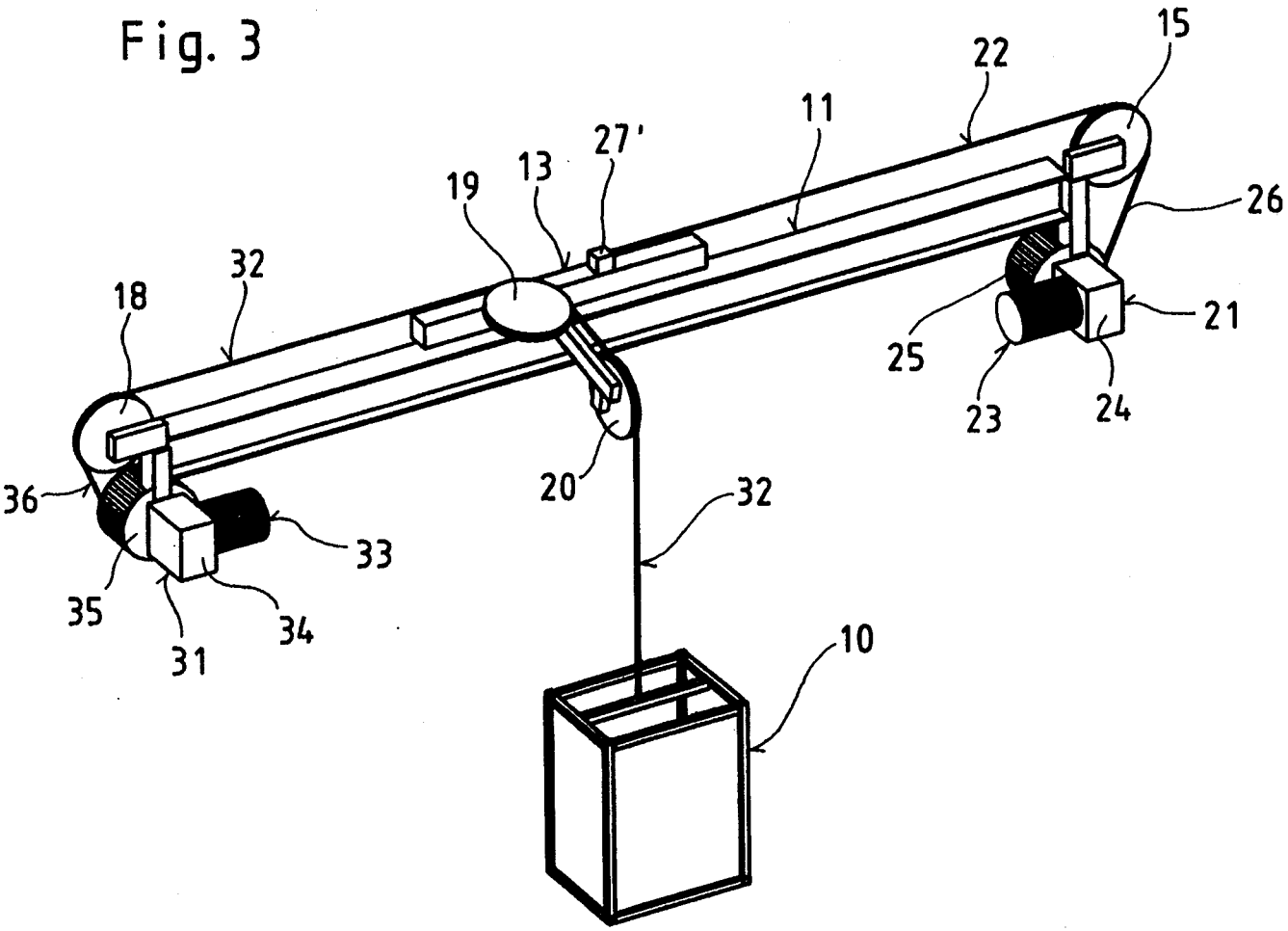
Figure 4:
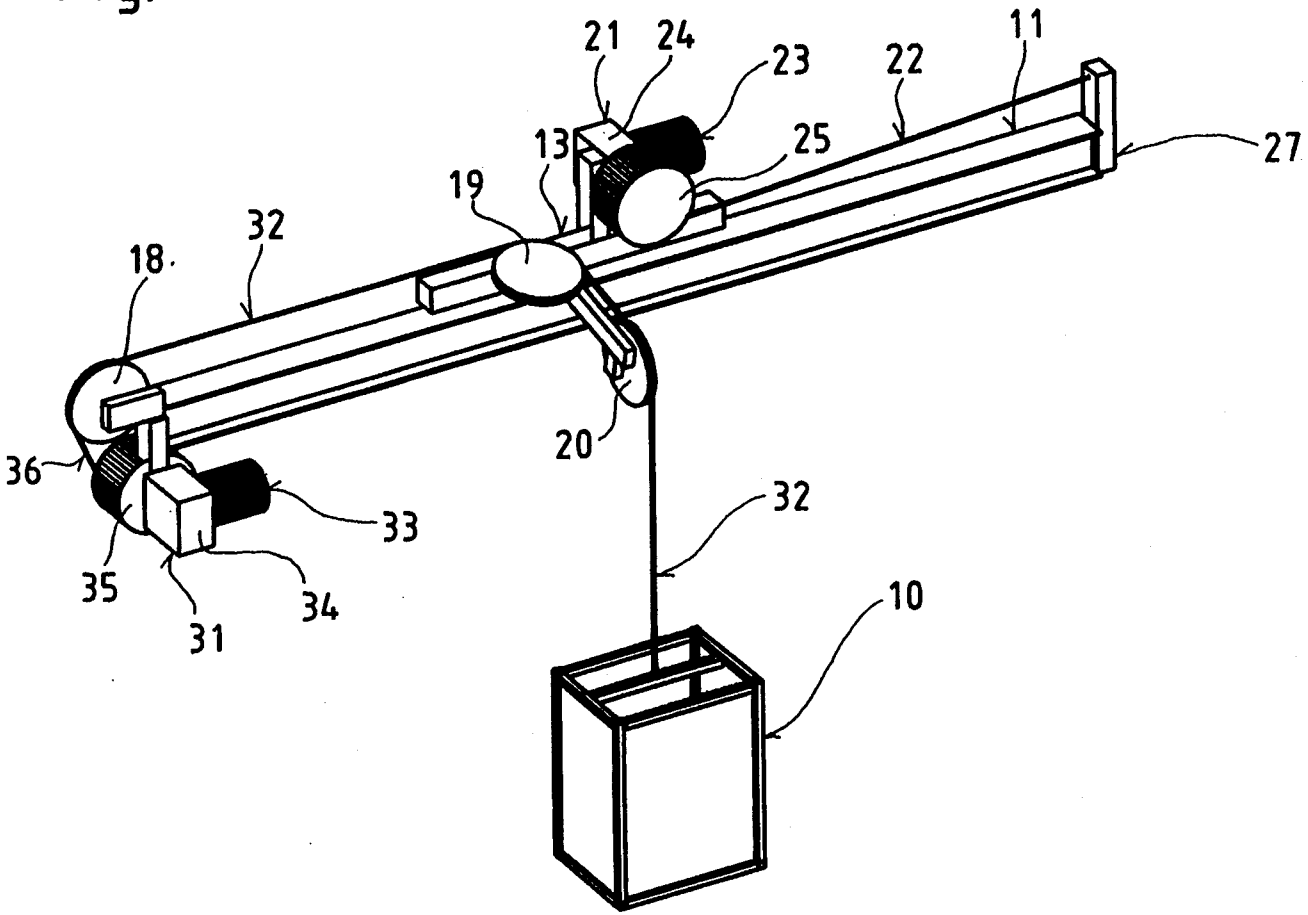

According to FIG. 3 the pulling member 22 of the drive unit 21 is connected with a fastener to the carriage 13. With the aid of the drive unit 21 that according to FIG. 4 can also be connected to the carriage 13, whereby the free end of the pulling member 22 is connected to the building 2 with the fastener 27, the carriage 13 is thus displaced along the guide rail 11, while the vertical position (height) of the gondola 10 is altered with the drive unit 31 that is connected via the pulling member 32 to the gondola 10.

Figure 5:
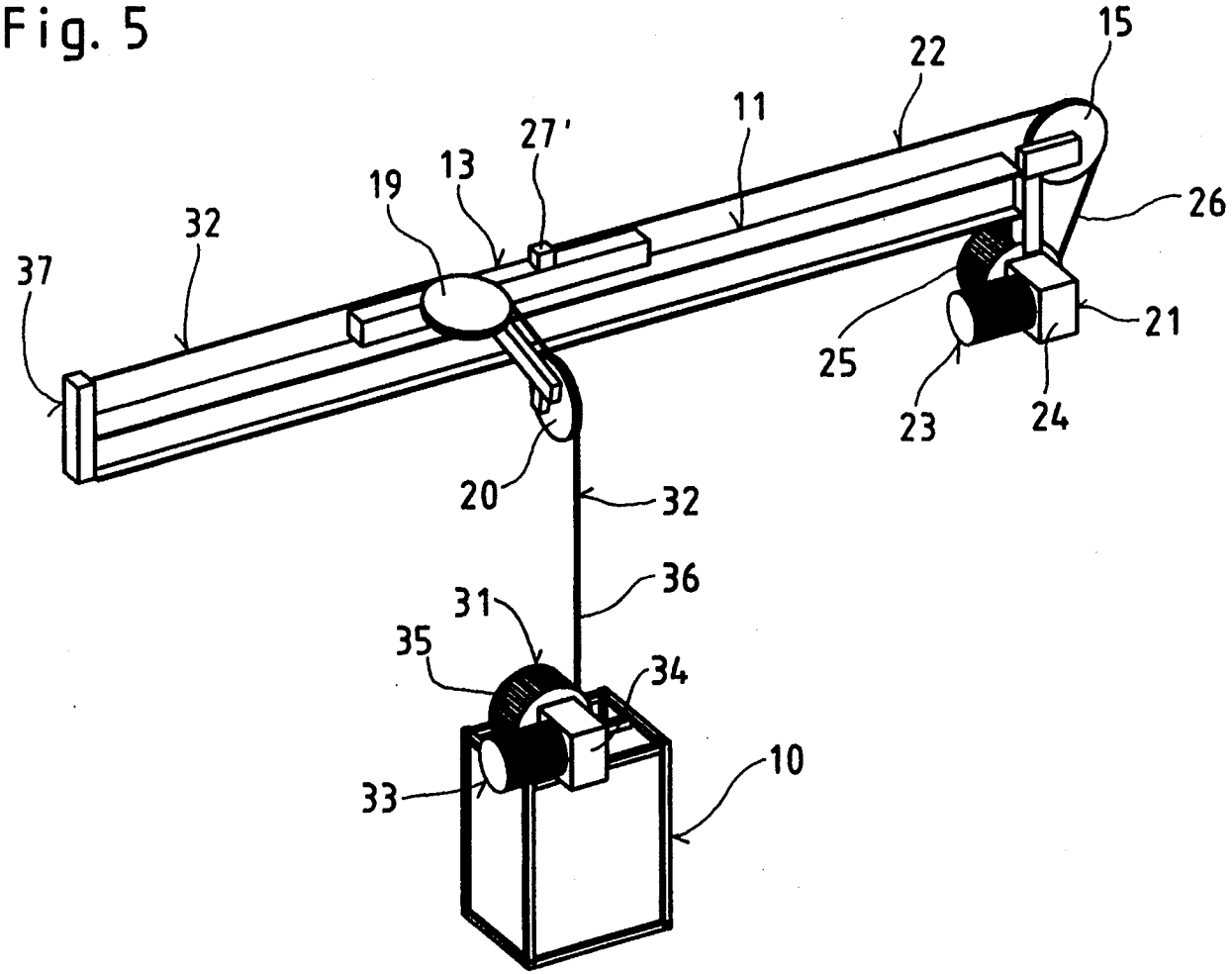

In the embodiment according to FIG. 5, the drive unit 31 is connected to the gondola 10, and the free end of a pulling member 32 is fastened with the fastener 37 to the building 2. The height adjustment of the gondola 10 is achieved with the aid of the drive unit 31. For a lateral displacement of the carriage 13 along the guide rail 11 the drive unit 21 is provided. The corresponding pulling member 22 is connected with the fastener 27' to the carriage 13.

Figure 6:
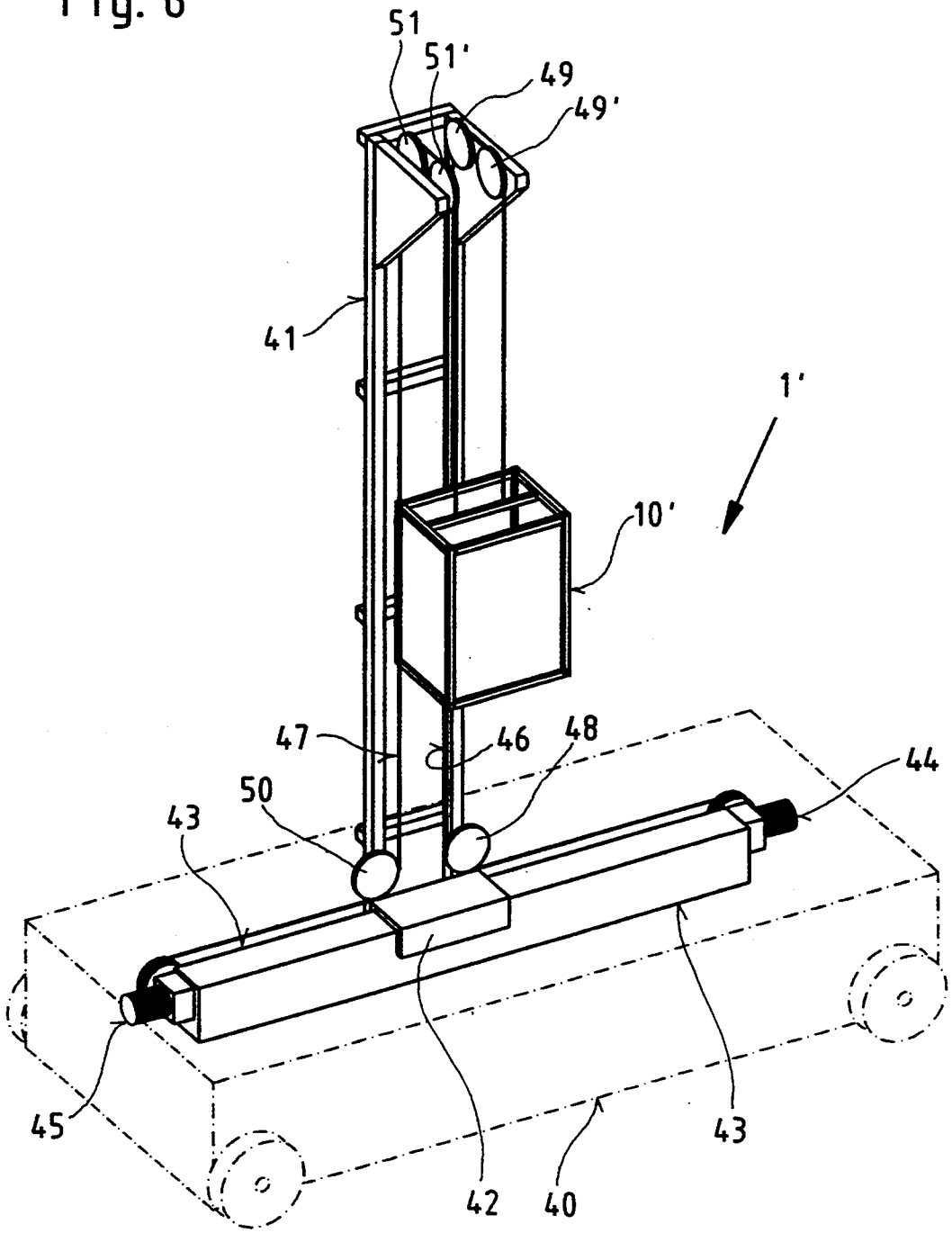
FIG. 6 shows a further embodiment of a device for displacing a gondola.

In the device 1' according to FIG. 6 a support structure 41 is provided for supporting a gondola 10' which support structure 41 is displaceable with a carriage 42 on a mobile platform 40 having arranged thereon a guide rail 43. On the mobile platform 40 two drive units 44 and 45 are provided which are in driving connection with the gondola 10' via the pulling members 46 and 47. The pulling members 46 and 47 are guided via guide pulleys 48, 49, 49' and 50, 51, 51' connected to the support structure 41.

With a controlled activation of the drive units 44 and 45 the gondola 10' can be lifted or lowered in the same manner as the device 1 of FIG. 1 and/or the support structure 41 can be laterally (horizontally) displaced with the carriage 42.

The present invention is, of course, in no way restricted to the specific disclosure of the specification and drawings, but also encompasses any modifications within the scope of the appended claims.

What I claim is:

1. A device for displacing a gondola in the vertical and horizontal direction alongside a building wall, said device comprising:

a guide rail with a first and a second end connected to a building;

a carriage slidably connected to said guide rail;

a gondola connected to said carriage so as to be vertically displaceable relative to said carriage and horizontally displaceable parallel with said carriage;

a first drive unit operatively connected to said gondola and comprising a first pulling member movable so as to be retractable into and releasable from said first drive unit for displacing said gondola;

a second drive unit operatively connected to said gondola and comprising a second pulling member movable so as to be retractable into and releasable from said second drive unit for displacing said gondola;

wherein said first and said second drive units cooperate with one another for displacing said gondola in the horizontal and the vertical direction and are activatable together in a first operative mode wherein said first and second pulling members are simultaneously retracted, in a second operative mode wherein said first and second pulling members are simultaneously released, a third operative mode wherein one of said first and second pulling members is released and the other of said first and second pulling members is retracted, and a fourth operative mode wherein only one of said first and second pulling members is moved, to thereby displace said gondola in the vertical and the horizontal direction as desired;

said first drive unit connected to said first end of said guide rail;

said first pulling member connected with a free end thereof to said gondola;

said second drive unit connected to said second end of said guide rail; and said second pulling member connected with a free end thereof to said gondola.

2. A device according to claim 1, wherein said first and said second pulling members are selected from a group consisting of cables and chains, and wherein said carriage comprises at least one pair of guide pulleys positioned perpendicular to one another for deflecting at least one of said first and second pulling members from the horizontal direction to the vertical direction.

3. A device according to claim 1, wherein said first and second drive units are reversing electric geared motors comprising a reeling drum for receiving said first and second pulling members.

4. A device according to claim 1, wherein said first and second drive units have a reeling device with a drive motor selected from the group consisting of a driving pulley, a winch, and a capstan.

5. A device according to claim 1, further comprising a support structure from which said gondola is suspended by said pulling members.

* * * * *